US008968518B2

(12) United States Patent
F. Chin et al.

(10) Patent No.: US 8,968,518 B2
(45) Date of Patent: Mar. 3, 2015

(54) PAPERMAKING PROCESS EMPLOYING CARBOXYLATED CELLULOSIC FIBERS

(71) Applicant: Goldeast Paper (Jiangsu) Co., Ltd, Zhenjiang (CN)

(72) Inventors: Yungchang F. Chin, Zhenjiang (CN); Cui-Xia Wang, Zhenjiang (CN); Ke-Cheng Fu, Zhenjiang (CN); Pu Ma, Zhenjiang (CN); Ren-Rong Wang, New Taipei (TW)

(73) Assignee: Goldeast Paper (Jiangsu) Co., Ltd., Zhenjiang, Jiangsu Province (CN)

( * ) Notice: Subject to any disclaimer, the term of this patent is extended or adjusted under 35 U.S.C. 154(b) by 0 days.

(21) Appl. No.: 14/011,758

(22) Filed: Aug. 28, 2013

(65) Prior Publication Data

US 2014/0305605 A1 Oct. 16, 2014

(30) Foreign Application Priority Data

Apr. 15, 2013 (CN) ..... 2013 1 0129816

(51) Int. Cl.
*D21F 11/00* (2006.01)

(52) U.S. Cl.
USPC ..... 162/157.6

(58) Field of Classification Search
USPC ..... 162/157.6, 129–130, 9, 146, 164.3, 123
See application file for complete search history.

(56) References Cited

U.S. PATENT DOCUMENTS

| | | | | |
|---|---|---|---|---|
| 6,379,494 | B1 * | 4/2002 | Jewell et al. | 162/9 |
| 6,749,721 | B2 * | 6/2004 | Shannon et al. | 162/164.4 |
| 6,824,645 | B2 * | 11/2004 | Jaschinski et al. | 162/9 |
| 6,919,445 | B2 * | 7/2005 | Benson et al. | 536/26.6 |
| 7,109,325 | B2 * | 9/2006 | Komen et al. | 536/124 |
| 7,135,557 | B2 * | 11/2006 | Weerawarna et al. | 536/1.11 |
| 2005/0028955 | A1 * | 2/2005 | Winslow | 162/129 |
| 2005/0028956 | A1 * | 2/2005 | Winslow | 162/129 |

* cited by examiner

*Primary Examiner* — Mark Halpern
(74) *Attorney, Agent, or Firm* — Cheng-Ju Chiang

(57) ABSTRACT

A papermaking process includes, firstly, providing carboxylated cellulosic fibers with a carboxyl group content being in the range from 0.06 to 1.5 mmol/g. Then the carboxylated cellulosic fibers are employed to prepare mixing pulp including filler particles, wherein the content of the carboxylated cellulosic fibers in the mixing pulp is in the range from 40% to 100% by dry fiber weight of the mixing pulp. After that, paper is made employing the mixing pulp.

10 Claims, No Drawings

PAPERMAKING PROCESS EMPLOYING CARBOXYLATED CELLULOSIC FIBERS

CROSS-REFERENCE TO RELATED APPLICATION

This application claims the benefit of priority to People's Republic of China Patent Application No. 201310129816.X, Ser. No. 2013041600769200, filed Apr. 15, 2013, which is hereby incorporated by reference herein in its entirety.

BACKGROUND

1. Technical Field

The present disclosure relates to papermaking processes.

2. Description of Related Art

Generally, retention agents including acrylamide and starch are used to improve the filler particle retention rate of paper pulp. However, for precipitated calcium carbonate (PCC) and other filler particles having smaller particle size, the filler particle retention effect of the retention agents is weaker than for filler particles having larger particle size, such as ground calcium carbonate and kaolin.

Therefore, what is needed is a papermaking process which can effectively improve the retention rate of precipitated calcium carbonate and other filler particles having smaller particle size.

DETAILED DESCRIPTION

In one embodiment, the present disclosure provides a papermaking process which includes the following steps:

Step 1: providing carboxylated cellulosic fibers with carboxyl group content being in the range from 0.06 to 1.5 mmol/g (millimoles/gram).

In this embodiment, the carboxylated cellulosic fibers are obtained from plant fibers modified by a TEMPO (2,2,6,6-tetramethyl-piperidine-1-oxyl) catalytic oxidation system. In the present disclosure, the plant fibers include softwood, hardwood, grass fiber, and other plant fiber raw material. In this embodiment, the plant fibers are softwood, hardwood, or a mixture thereof, and the carboxyl group content of the carboxylated cellulosic fibers is in the range from 0.15 to 0.5 mmol/g.

In this embodiment, the TEMPO catalytic oxidation system comprises catalyst, oxidant, and assistant catalyst. The catalyst is TEMPO or derivatives of TEMPO. The oxidant is one or more items selected from the group consisting of hypochlorite, chlorite, chlorate, hydrogen peroxide, and chlorine dioxide. The assistant catalyst consists of iodides, bromides, or a mixture thereof.

The plant fibers are a polyhydroxy compounds, and each chain of the glucose of the plant fibers has three active hydroxyl groups (—OH) including a primary hydroxyl group and two secondary hydroxyl groups. Generally, the primary hydroxyl groups and secondary hydroxyl groups can all be oxidized to carboxyl groups (—COOH). Different types of hydroxyl groups have different oxidation mechanisms. Thus, according to different needs, the oxidation system can be a non-selective oxidation system or a selective oxidation system.

The non-selective oxidation system is a kind of oxidation system which can oxidize both the primary hydroxyl groups and the secondary hydroxyl groups to carboxyl groups. The non-selective oxidation system can utilize one or more items from the group consisting of sodium hypochlorite, hydrogen peroxide, and persulfate. The selective oxidation system is a kind of oxidation system which can selectively oxidize the secondary hydroxyl groups or the primary hydroxyl groups to carboxyl groups. Oxidation systems which can selectively oxidize the primary hydroxyl groups to carboxyl groups are selected from the group consisting of a TEMPO catalyst oxidation system, a hypochlorite oxidation system, an $NO_2$ and $N_2O_4$ series of nitric oxide oxidation system, and an oxidation system containing sodium bromate, sodium chlorate and sodium chlorite. Oxidation systems which can selectively oxidize the secondary hydroxyl groups to carboxyl groups utilize one item or both items selected from the group consisting of periodic acids and periodate.

Step 2: employing the carboxylated cellulosic fibers to prepare mixing pulp with filler particles added therein, wherein the content of carboxylated cellulosic fibers in the mixing pulp is in the range from 40% to 100% by dry fiber weight of the mixing pulp.

In this embodiment, the content of carboxylated cellulosic fibers in the mixing pulp is in the range from 40% to 50% by dry fiber weight of the mixing pulp.

In this embodiment, the content of filler particles in the mixing pulp is in the range from 1% to 80% by dry fiber weight of the mixing pulp. Typically, it is desired that the content of filler particles in the mixing pulp is in the range from 20% to 60% by dry fiber weight of the mixing pulp. It is to be understood that the content of filler particles in the mixing pulp can be changed according to practical needs.

Step 3: making paper employing the mixing pulp.

Unlike with conventional processes, in the above-described papermaking process of the present disclosure, the carboxylated cellulosic fibers with carboxyl group content being in the range from 0.06 to 1.5 mmol/g are used as the main fiber of the mixing pulp to make paper, which the content of the carboxylated cellulosic fibers in the mixing pulp being in the range from 40% to 100% by dry fiber weight of the mixing pulp. The much content of the carboxylated cellulosic fibers in the mixing pulp and the large number of carboxyl groups of the carboxylated cellulosic fibers are able to not only improve the swelling of fibers of the mixing pulp and enhance the binding force between fibers so as to form a denser fibrous network structure in the mixing pulp, but also enhance the binding force between the fibers and the filler particles. Due to the denser fibrous network structure and the greater binding force between the fibers and the filler particles, the mixing pulp can obtain excellent filler retention performance and the final paper product can obtain higher filler content.

INTRODUCTION TO EXAMPLES

Three sets of examples are provided. In the following three sets of examples, the plant fiber type is LBKP (Laubhölxer bleached kraft pulp), the concentration of paper pulp is 1%, the mixer speed is 900 rpm (revolutions per minute), the mixing time is 3 mins (minutes), the term "non-oxidative LBKP pulp" means that the LBKP has not been modified by an oxidation system, and the term "oxidative LBKP pulp" means that the LBKP has been modified by an oxidation system.

First Set of Examples

The first set of examples is provided to compare ash content and ash retention rate between final paper products made respectively from: (i) non-oxidative LBKP pulp; and (ii) oxidative LBKP pulp having different carboxyl amounts; wherein all the examples have the same filler content and the same LBKP pulp content.

Comparative Example 1

Preparing mixing pulp with non-oxidative LBKP pulp, and with PCC filler in the amount of 45% by dry fiber weight of the mixing pulp; making paper employing the mixing pulp; and testing the ash content and ash retention rate of the final paper product.

Application Example 1

Preparing mixing pulp with oxidative LBKP pulp having a carboxyl group content of 0.2 mmol/g, and with PCC filler in the amount of 45% by dry fiber weight of the mixing pulp, wherein the content of the oxidative LBKP pulp is the same as the content of the non-oxidative LBKP pulp used in comparative example 1; making paper employing the mixing pulp; and testing the ash content and ash retention rate of the final paper product.

Application Example 2

Preparing mixing pulp with oxidative LBKP pulp having a carboxyl group content of 0.7 mmol/g, and with PCC filler in the amount of 45% by dry fiber weight of the mixing pulp, wherein the content of the oxidative LBKP pulp is the same as the content of the non-oxidative LBKP pulp used in comparative example 1; making paper employing the mixing pulp; and testing the ash content and ash retention rate of the final paper product.

Application Example 3

Preparing mixing pulp with oxidative LBKP pulp having a carboxyl group content of 1.5 mmol/g, and with PCC filler in the amount of 45% by dry fiber weight of the mixing pulp, wherein the content of the oxidative LBKP pulp is the same as the content of the non-oxidative LBKP pulp used in comparative example 1; making paper employing the mixing pulp; and testing the ash content and ash retention rate of the final paper product.

Second Set of Examples

The second set of examples is provided to compare ash content and ash retention rate between final paper products made respectively from non-oxidative LBKP pulp and oxidative LBKP pulp. Three pairs of examples are provided. In each pair, the non-oxidative LBKP pulp content and the oxidative LBKP pulp content are the same, and the filler content is the same. Across the three pairs, three different filler contents are employed.

Comparative Example 1

Preparing mixing pulp with non-oxidative LBKP pulp, and with PCC filler in the amount of 5% by dry fiber weight of the mixing pulp; making paper employing the mixing pulp; and testing the ash content and ash retention rate of the final paper product.

Application Example 1

Preparing mixing pulp with oxidative LBKP pulp having a carboxyl group content of 0.2 mmol/g, and with PCC filler in the amount of 5% by dry fiber weight of the mixing pulp, wherein the content of the oxidative LBKP pulp is the same as the content of the non-oxidative LBKP pulp used in comparative example 1; making paper employing the mixing pulp; and testing the ash content and ash retention rate of the final paper product.

Comparative Example 2

Preparing mixing pulp with non-oxidative LBKP pulp, and with PCC filler in the amount of 40% by dry fiber weight of the mixing pulp, wherein the content of the non-oxidative LBKP pulp is the same as the content of the non-oxidative LBKP pulp used in comparative example 1; making paper employing the mixing pulp; and testing the ash content and ash retention rate of the final paper product.

Application Example 2

Preparing mixing pulp with oxidative LBKP pulp having a carboxyl group content of 0.2 mmol/g, and with PCC filler in the amount of 40% by dry fiber weight of the mixing pulp, wherein the content of the oxidative LBKP pulp is the same as the content of the non-oxidative LBKP pulp used in comparative example 2; making paper employing the mixing pulp; and testing the ash content and ash retention rate of the final paper product.

Comparative Example 3

Preparing mixing pulp with non-oxidative LBKP pulp, and with PCC filler in the amount of 80% by dry fiber weight of the mixing pulp, wherein the content of the non-oxidative LBKP pulp is the same as the content of the non-oxidative LBKP pulp used in comparative example 1; making paper employing the mixing pulp; and testing the ash content and ash retention rate of the final paper product.

Application Example 3

Preparing mixing pulp with oxidative LBKP pulp having a carboxyl group content of 0.2 mmol/g, and with PCC filler in the amount of 80% by dry fiber weight of the mixing pulp, wherein the content of the oxidative LBKP pulp is the same as the content of the non-oxidative LBKP pulp used in comparative example 3; making paper employing the mixing pulp; and testing the ash content and ash retention rate of the final paper product.

Third Set of Examples

The third set of examples is provided to compare ash content and ash retention rate between final paper products made respectively from different contents of oxidative LBKP pulp having a carboxyl group content of 0.2 mmol/g, wherein all the examples have the same filler content.

Application Example 1

Preparing mixing pulp with non-oxidative LBKP pulp, with oxidative LBKP pulp in the amount of 5% by dry fiber weight of the mixing pulp, and with PCC filler in the amount of 45% by dry fiber weight of the mixing pulp; making paper employing the mixing pulp; and testing the ash content and ash retention rate of the final paper product.

Application Example 2

Preparing mixing pulp with non-oxidative LBKP pulp, with oxidative LBKP pulp in the amount of 40% by dry fiber weight of the mixing pulp, and with PCC filler in the amount of 45% by dry fiber weight of the mixing pulp; making paper employing the mixing pulp; and testing the ash content and ash retention rate of the final paper product.

Application Example 3

Preparing pulp with 100% oxidative LBKP pulp, and with PCC filler in the amount of 45% by dry fiber weight of the oxidative LBKP pulp; making paper employing the pulp; and testing the ash content and ash retention rate of the final paper product.

Results

The test results of the three sets of examples are summarized in the following table.

| | | ash content | ash retention rate |
|---|---|---|---|
| The first set of examples | Comparative example 1 non-oxidative LBKP pulp + 45% PCC | 8.93% | 21.79% |
| | Application example 1 oxidative LBKP pulp (carboxyl group content is 0.2 mmol/g) + 45% PCC | 19.86% | 55.07% |
| | Application example 2 oxidative LBKP pulp (carboxyl group content is 0.7 mmol/g) + 45% PCC | 22.16% | 63.26% |
| | Application example 3 oxidative LBKP pulp (carboxyl group content is 1.5 mmol/g) + 45%PCC | 28.98% | 90.68% |
| The second set of examples | Comparative example 1 non-oxidative LBKP pulp + 5% PCC | 0.82% | 16.54% |
| | Application example 1 oxidative LBKP pulp (carboxyl group content is 0.2 mmol/g) + 5% PCC | 3.64% | 33.35% |
| | Comparative example 2 non-oxidative LBKP pulp + 40% PCC | 9.28% | 25.57% |
| | Application example 2 oxidative LBKP pulp (carboxyl group content is 0.2 mmol/g) + 40% PCC | 20.28% | 55.92% |
| | Comparative example 3 non-oxidative LBKP pulp + 80% PCC | 17.12% | 25.82% |
| | Application example 3 oxidative LBKP pulp (carboxyl group content is 0.2 mmol/g) + 80% PCC | 37.09% | 67.57% |
| The third set of examples | Application example 1 mixing pulp including 5% oxidative LBKP pulp (carboxyl group content is 0.2 mmol/g) and 45% PCC | 13.26% | 33.68% |
| | Application example 2 mixing pulp including 40% oxidative LBKP pulp (carboxyl group content is 0.2 mmol/g) and 45% PCC | 24.08% | 67.43% |
| | Application example 3 pulp being 100% oxidative LBKP pulp (carboxyl group content is 0.2 mmol/g) and 45% PCC | 24.86% | 65.85% |

The test results of the first set of examples demonstrate that the ash content and ash retention rate of final paper products made from the oxidative LBKP pulp are much higher than the ash content and ash retention rate of final paper products made from the non-oxidative LBKP pulp.

It can be seen from the test results of the second set of examples that on condition that the content of carboxyl groups of the oxidative LBKP pulp is kept the same and when the filler content used in the paper pulp is varied, the ash content and ash retention rate of final paper products made from the oxidative LBKP pulp are much higher than the ash content and ash retention rate of final paper products made from the non-oxidative LBKP pulp, no matter how much filler content is used in the paper pulp.

It is also seen from the test results of the third set of examples that on condition that the content of oxidative LBKP pulp having the same content of carboxyl groups is progressively increased, the ash content and ash retention rate of final paper products show an obvious increase at first and later trend toward stable values.

Combining the above-described test results of the three sets of examples, it can be concluded that the papermaking process provided by the present disclosure greatly improves the retention rate of the precipitated calcium carbonate and other filler particles which have smaller particle size, by using the carboxylated cellulosic fibers whose carboxyl group content is in the range from 0.06 to 1.5 mmol/g as a part of or all of the main fiber to make paper.

It is to be understood that, according to different needs, acrylamide, starch and other retention agents commonly used in the field of papermaking can also be used in the papermaking process of the present disclosure to further improve the filler retention rate of the paper pulp.

It is to be further understood that even though numerous characteristics and advantages of the present embodiments have been set forth in the foregoing description, together with details of the structures and functions of the embodiments, the disclosure is illustrative only, and changes may be made in detail, especially in matters of arrangement of parts within the principles of the disclosure to the full extent indicated by the broad general meaning of the terms in which the appended claims are expressed.

What is claimed is:

1. A papermaking process comprising:

providing carboxylated cellulosic fibers with carboxyl group content being in the range from 0.06 to 1.5 millimoles/gram;

employing the carboxylated cellulosic fibers to prepare mixing pulp with filler particles added therein, the content of carboxylated cellulosic fibers in the mixing pulp being in the range from 40% to 100% by dry fiber weight of the mixing pulp; and making paper employing the mixing pulp.

2. The papermaking process of claim 1, wherein the carboxyl group content of the carboxylated cellulosic fibers is in the range from 0.15 to 0.5 millimoles/gram.

3. The papermaking process of claim 1, wherein the content of the carboxylated cellulosic fibers in the mixing pulp is in the range from 40% to 50% by dry fiber weight of the mixing pulp.

4. The papermaking process of claim 1, wherein the content of the filler particles in the mixing pulp is in the range from 1% to 80% by dry fiber weight of the mixing pulp.

5. The papermaking process of claim 1, wherein the content of the filler particles in the mixing pulp is in the range from 20% to 60% by dry fiber weight of the mixing pulp.

6. The papermaking process of claim 1, wherein the carboxylated cellulosic fibers are obtained from plant fibers modified by a non-selective oxidation system that oxidizes both primary hydroxyl groups and secondary hydroxyl groups of the plant fibers to carboxyl groups.

7. The papermaking process of claim 6, wherein the non-selective oxidation system utilizes one or more items selected from the group consisting of sodium hypochlorite, hydrogen peroxide, and persulfate.

8. The papermaking process of claim 1, wherein the carboxylated cellulosic fibers are obtained from plant fiber modified by a selective oxidation system that selectively oxidizes primary hydroxyl groups or secondary hydroxyl groups of the plant fiber to carboxyl groups.

9. The papermaking process of claim 8, wherein in the case that the selective oxidation system selectively oxidizes primary hydroxyl groups to carboxyl groups, the selective oxidation system is selected from the group consisting of a TEMPO (2,2,6,6-tetramethyl-piperidine-1-oxyl) catalytic oxidation system, a hypochlorite oxidation system, an $NO_2$ and $N_2O_4$ series of nitric oxide oxidation system, and an oxidation system containing sodium bromate, sodium chlorate and sodium chlorite.

10. The papermaking process of claim 8, wherein in the case that the selective oxidation system selectively oxidizes secondary hydroxyl groups to carboxyl groups, the selective oxidation system utilizes one item or both items selected from the group consisting of periodic acid and periodate.

* * * * *